US007427101B1

(12) United States Patent
Zernov

(10) Patent No.: US 7,427,101 B1
(45) Date of Patent: Sep. 23, 2008

(54) CHAIR SHELTER

(75) Inventor: Jeff Zernov, Brainerd, MN (US)

(73) Assignee: Nature Vision, Inc., Brainerd, MN (US)

( * ) Notice: Subject to any disclaimer, the term of this patent is extended or adjusted under 35 U.S.C. 154(b) by 301 days.

(21) Appl. No.: 11/108,333

(22) Filed: Apr. 18, 2005

(51) Int. Cl.
*A47C 7/62* (2006.01)

(52) U.S. Cl. ..... 297/184.14; 297/184.17; 297/16.2; 135/96

(58) Field of Classification Search ..... 297/184.14, 297/184.15, 184.17, 16.2, 184.11, 184.1; 135/96, 136, 133, 124, 132
See application file for complete search history.

(56) References Cited

U.S. PATENT DOCUMENTS

| | | | | | |
|---|---|---|---|---|---|
| 8,222 | A * | 7/1851 | Hibbard | 296/111 |
| 1,033,108 | A * | 7/1912 | Lehman | 297/23 |
| 1,196,207 | A * | 8/1916 | Cane | 135/130 |
| 2,182,991 | A * | 12/1939 | Lazier | 560/239 |
| 4,914,768 | A * | 4/1990 | Howard | 5/113 |
| 4,915,120 | A * | 4/1990 | Ziolkowski | 135/90 |
| 4,971,089 | A * | 11/1990 | Braman | 135/90 |
| 5,018,227 | A * | 5/1991 | Canfield | 5/113 |
| 5,133,378 | A * | 7/1992 | Tanasychuk | 135/148 |
| 5,690,134 | A * | 11/1997 | McCauley | 135/133 |
| 5,984,406 | A * | 11/1999 | Lee | 297/16.2 |
| 6,296,002 | B1 * | 10/2001 | Tashchyan | 135/96 |
| 6,354,044 | B1 * | 3/2002 | Lagace, Jr. | 52/79.5 |
| 6,802,327 | B2 * | 10/2004 | Koss | 135/88.08 |
| 7,189,164 | B1 * | 3/2007 | Paesang et al. | 472/118 |
| 2005/0194028 | A1 * | 9/2005 | Shinner et al. | 135/90 |
| 2006/0220424 | A1 * | 10/2006 | Fargason, III | 297/184.17 |

* cited by examiner

*Primary Examiner*—David R Dunn
*Assistant Examiner*—Patrick D Lynch
(74) *Attorney, Agent, or Firm*—D L Tschida

(57) ABSTRACT

A collapsible user support coupled to a collapsible, walled shelter. One assembly provides a sling chair having a number of frame pieces that are trained through grommets at a fabric seat and backrest fitted to pivot couplers. Armrests are optionally included along with accessory supports and pockets. Pivoting link arms couple to stay or bow pieces of an independently collapsible shelter. The shelter frame pieces mount to pivot couplers and a surrounding multi-panel fabric shelter. The shelter can include windows and/or doors and/or vents with fasteners. The chair and shelter frameworks and fabric shelter are organized to collapse and deploy to several seating conditions ranging from the chair being partially to completely protected from the environment.

19 Claims, 15 Drawing Sheets

CHAIR SHELTER

BACKGROUND OF THE INVENTION

The present invention relates to portable shelters and, in particular, to a collapsible shelter fitted to a collapsible chair for use during outdoor recreation, such as ice fishing, hunting and summer camping or beach recreation.

Portable shelters for ice fishing have been constructed in a variety of designs. Many recent designs provide for rigid walled shelters that mount on trailer frames. Beds, cabinets, stoves, lights, hole covers and other accommodations are permanently mounted to the walls, floors and ceiling. The wheels are rotated down for travel and up when located of a fishing spot.

Some shelter designs are constructed on runners with rigid, windowed walls in the form of small outbuildings. The structures are insulated for heat retention and use for several days. Heating and cooking appliances are added as desired. These shelters are towed on and off the ice each season.

Some designs provide fabric-covered tents that can include sewn floors or open floors. An associated collapsible framework supports the fabric. Associated mechanisms must be included to securely anchor the shelter against wind.

Still other portable designs provide frames that pivot or mount to a rigid base that can comprise a folded floor and/or a sled. Tubular frame members mounted to the floor or sled support a fabric enclosure with sewn windows and zippered doors. The members are typically mounted to pivot at the base/sled. Benches or seats are frequently adapted to the base/sled. Open chairs can be used with the open floor models and can also be set into the larger sleds. Such designs are typically constructed for 1 to 6 or more users.

On occasion buckets and chairs are set on the ice and used without a surrounding shelter, especially on sunny, warm weather days and nights. Each of the foregoing provides advantages and disadvantages in regards to cost, portability and durability; consequently, the large numbers of alternative designs.

A variety of summer assemblies have also been developed for the beach to shade a user from the UV rays of the sun. Some provide chairs with associated umbrellas that can be trained to shade the user. Tent-like assemblies have also been suggested for protecting or controlling exposure to the sun and protection from insects.

A variety of blind assemblies have also been developed for waterfowl and turkey hunters. Many are constructed in the form of tents. Some are configured as animals and some are configured to position the hunter in a reclined or supine posture.

The present invention was developed to provide another alternative portable shelter that finds particular application with winter sports, such as ice fishing, although can be adapted to hunting and summer/beach and camping recreation activities. The assembly provides a low-cost collapsible, portable shelter that is readily deployed and transported. The shelter provides multiple fabric panel walls that are supported to a collapsible shelter framework. The shelter framework, in turn, is attached to a collapsible chair. The collapsible shelter framework presently attaches to a preferred collapsible sling chair, although could be adapted to a variety of rigid or folding chairs. The collapsible chair framework supports fabric seat, backrest and/or armrest supports.

The shelter framework includes a number of hinged frame pieces that pivot to define a rigid support frame for several attached fabric panels that define enclosure walls. With the chair and shelter frameworks expanded, the shelter walls can be rotated between selected partially open and covering conditions to shade or completely shelter the chair and user from the elements (i.e. sun, wind, rain or snow) and insects.

SUMMARY OF THE INVENTION

It is a primary object of the present invention to provide a portable shelter that includes an integrated collapsible shelter and user support (e.g. chair, bench or recliner).

It is a further object of the present invention to provide a shelter that can be deployed to pre-defined latched conditions that completely enclose and/or partially cover the user and the underlying ground, sand or ice.

It is a further object of the invention to provide a fabric shelter that is supported to a collapsible framework.

It is a further object of the invention to provide a shelter having a user support that is independently collapsible, for example, a sling chair, stool or folding chair with a rigid or flexible sling seat, armrest and/or backrest pieces.

It is a further object of the invention to provide a shelter including a collapsible, sling chair.

It is a further object of the invention to provide a combination shelter and chair assembly that collapses for storage and transport in a carry bag, yet deploys in minutes.

The foregoing objects, advantages and distinctions of the invention, among others, are found in two considered assemblies that provide a collapsible sling chair. In one construction, the chair includes a number of frames pieces that are trained through grommets at the fabric and fitted to pivot couplers. Armrests are optionally included along with accessory supports and storage pockets.

Secured to the frame pieces of the chair are a number of pivotal link arms that, in turn, couple to stay-like frame pieces of an independently collapsible shelter. The shelter frame pieces include pivot couplers. Some of the shelter frame pieces may telescope. Some of the shelter frame pieces are secured to multiple, surrounding fabric panels. The shelter can include windows and/or doors and/or vents with fasteners (e.g. zippers, snaps, hook/loop fasteners). The shelter frame pieces and fabric panels are organized to collapse and deploy with the chair. Collectively the assembly can be stored in a stuff or duffle bag.

In another shelter construction, several flexible bow stays are mounted to rotate at a pivot plate secured to arm rests at a chair. The stays are secured to enclosure panels. The stays can be rotated to partially or completely enclose the chair and seated occupant. That is, when the chair and shelter are erected, the stays can be rotated to several conditions wherein the chair and user are partially or completely protected from the environment. A user seated at the chair is also able to obtain protection from the wind and sun and with the aid of auxiliary appliances arrayed within the covered space. The heat/light sources can control internal ambient conditions to a desired personal comfort level.

Still other objects, advantages and distinctions of the invention will become more apparent from the following description with respect to the appended drawings. Considered alternative constructions, improvements or modifications are described as appropriate. The following description should therefore not be literally construed in limitation of the invention. Rather, the scope of the invention should be broadly interpreted within the scope of the further appended claims.

DESCRIPTION OF THE PREFERRED EMBODIMENT

With attention to FIGS. 1 through 4, perspective views are shown to erected conditions of a first presently preferred collapsible chair-shelter assembly 2 of the invention. FIGS. 5-9 depict views to the shelter 4 and/or chair or user support 6 in different stages of collapse, prefatory to deployment or storage.

Figure 1:
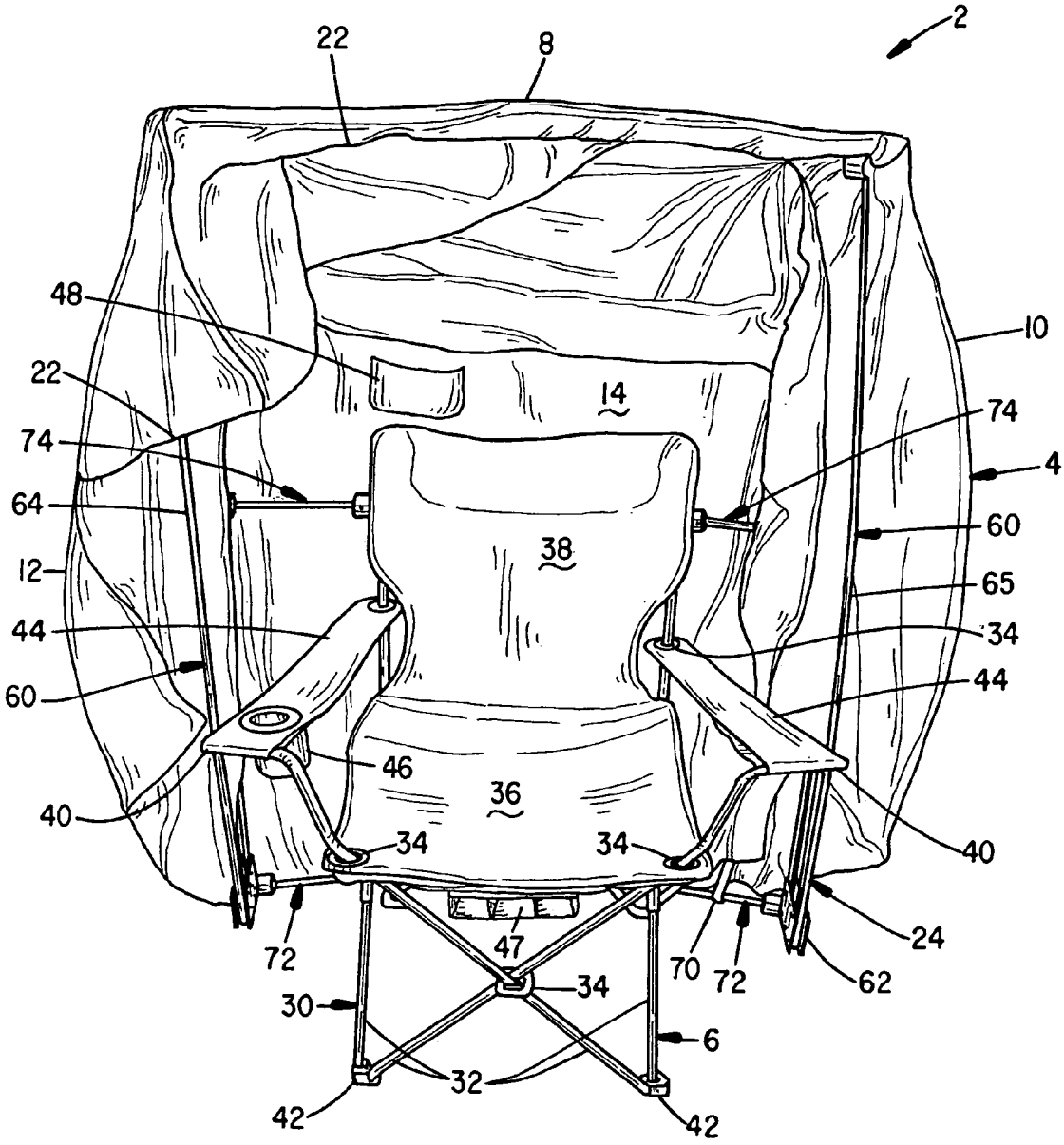
FIG. 1 shows a front perspective view of one construction of the present shelter with the shelter raised to expose the user chair.
Figure 4:
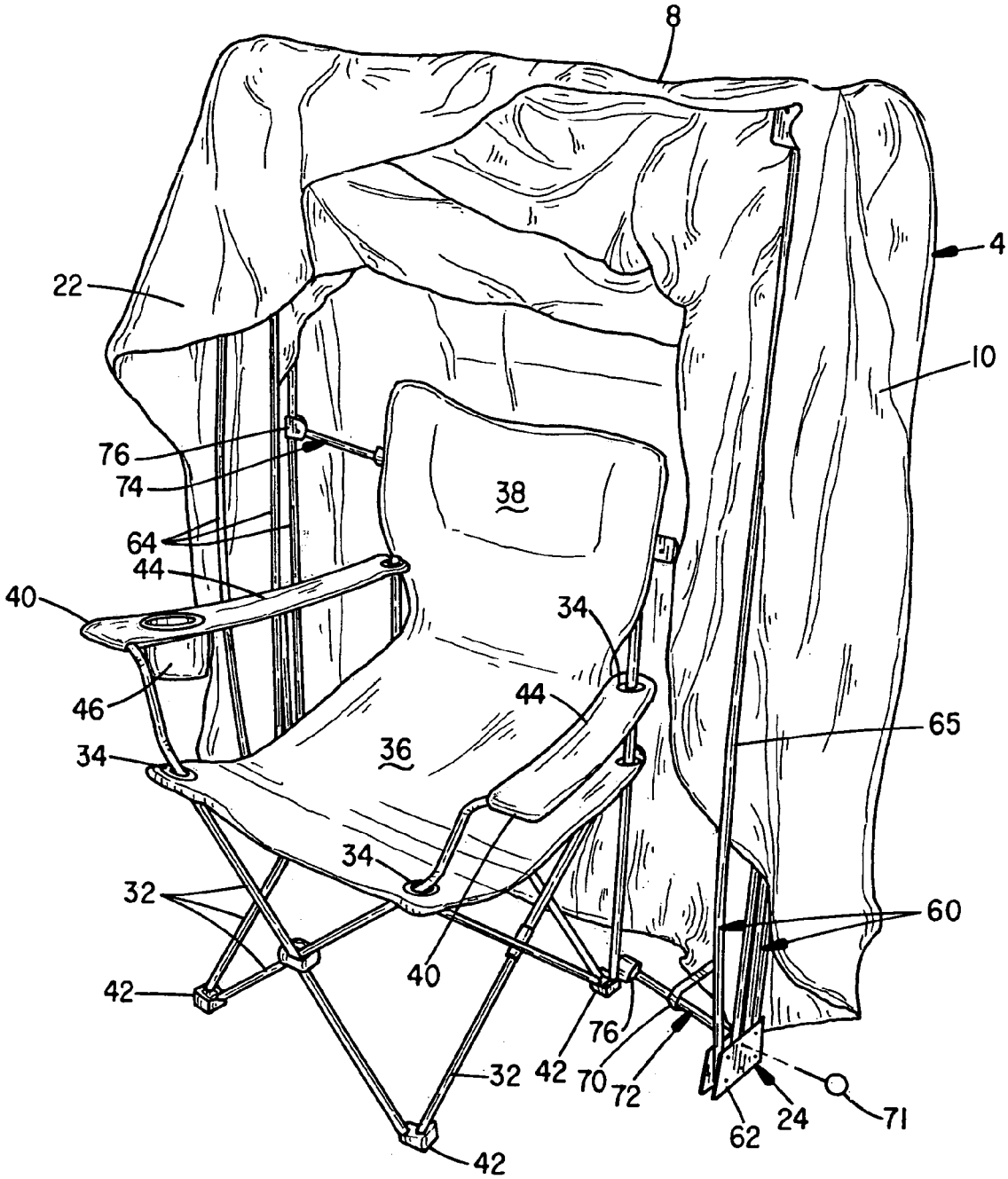
FIG. 4 shows a perspective view of the shelter with the rear shelter walls rotated erect to a vertical condition to provide a windbreak relative to the erected user chair.

The chair 6 is shown with the shelter 4 deployed and pivoted to an upright "windbreak" condition in FIGS. 1 and 4. Such a condition can exist when entering or exiting the shelter 4 or in fair/sunny weather conditions, when the shelter 4 is used as a windbreak. The front wall 8 and sidewalls 10 and 12 of the shelter 4 are then essentially rotated and held upright and the rear wall 14 is positioned toward the wind or sun.

The walls 8-14 are typically sewn together from a series of fabric panels to define a preferred finished form. The type of fabric and coloration varies depending upon the application. Light weight fabrics or mesh netting finds particular application in the summer. Tightly woven and/or waterproof fabrics find application for windy, wet and/or cold conditions. The latter fabrics tend also to trap heat from an auxiliary heat source that might be used with the shelter.

Figure 2:
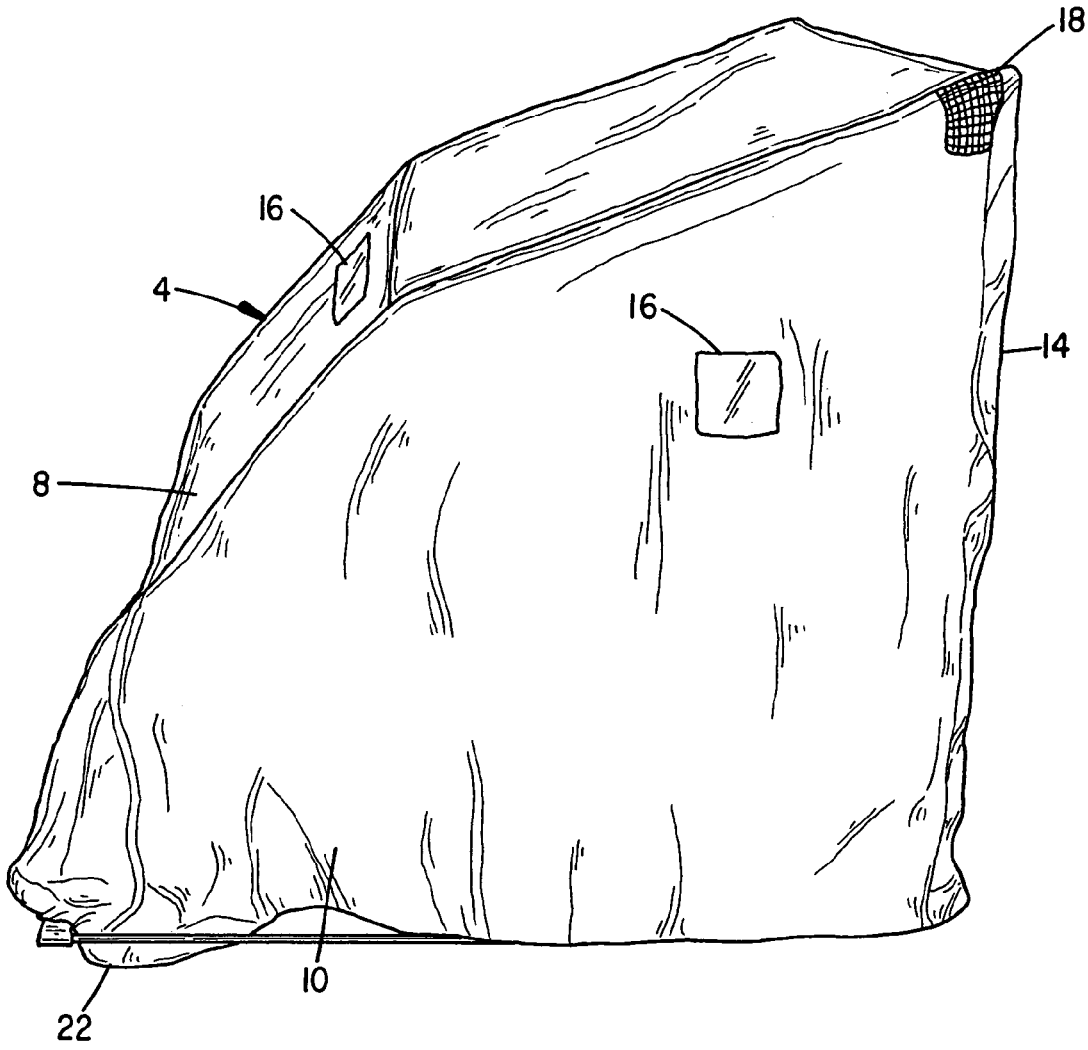
FIG. 2 shows a side view of the shelter rotated to completely enclose the chair and user.
Figure 3:
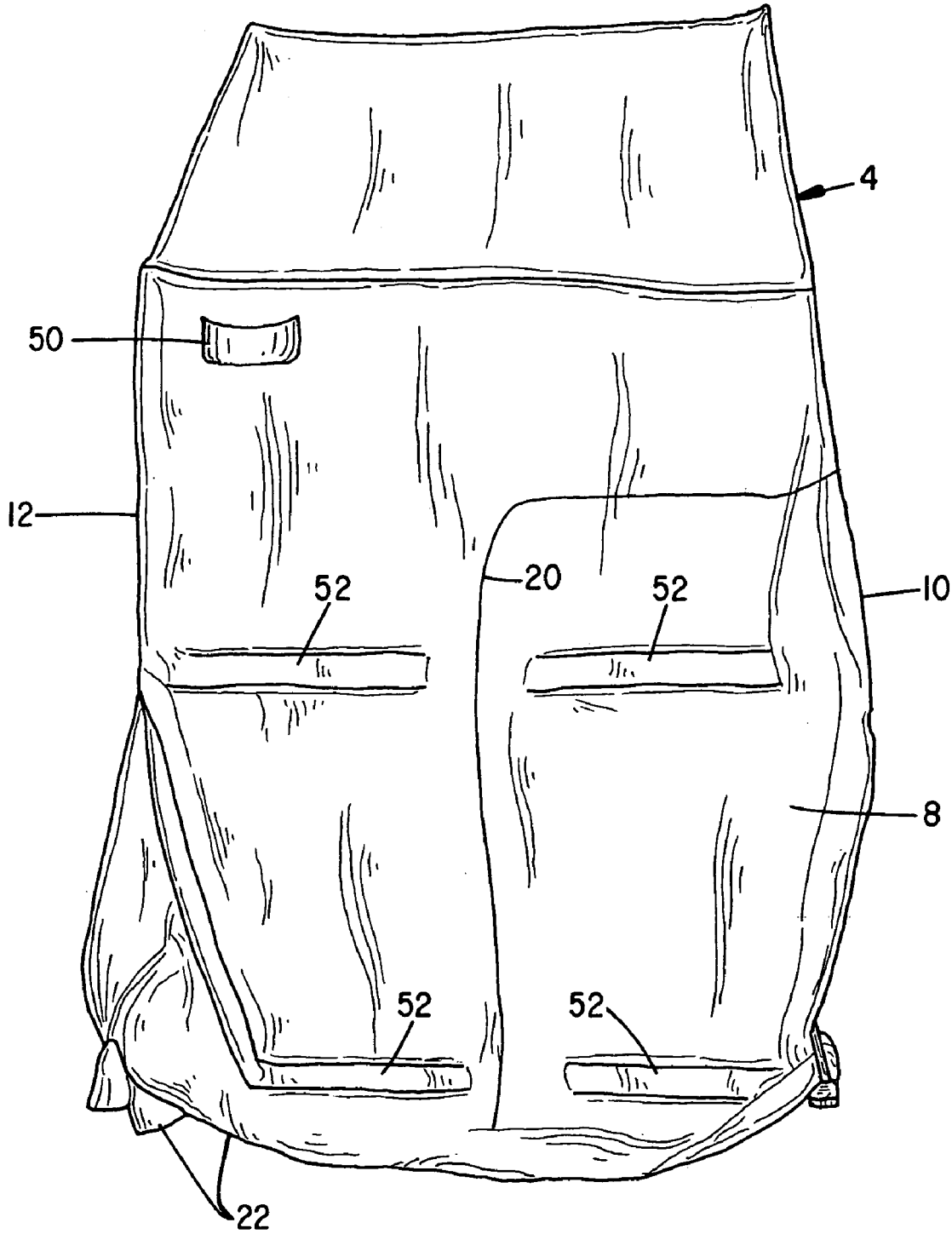
FIG. 3 shows a rear view of the shelter rotated to the partially open condition of FIG. 1.

FIG. 2 depicts a side view of the shelter 4 as it appears with the front wall 8 and sidewalls 10 and 12 rotated down to completely enclose the chair 6 and occupant. One or more windows 16 and/or vents 18 can be arrayed about the shelter 4 to facilitate viewing and ventilation in this condition.

For a shelter assembly 2 constructed to accommodate ice fishing, the assembly 2 can be sized to shelter one or more ice holes that would typically be drilled in front of the chair 6. Other sheltered accessories might include a bait container, tackle container, sonar/camera display and gas or battery light. A portable heater might also be covered by the shelter 4 to heat the interior space and fisherman. One or more zippered openings 20 in the front or side walls 8, 10 or 12 can also be included to facilitate subsequent exit, entry and venting of the shelter 4. The walls 8, 10 and 12 of the assembly 2 can be arranged to selectively permit partially lowered/raised conditions as desired by the user to provide ventilation etc.

If the assembly 2 is constructed for hunting, the walls can be formed from fabrics that exhibit a suitable camouflage appearance. Portions of the wall panels 8-14 can be removed or provided with detachable fasteners that permit exposing the interior for shooting.

The shelter 4 can also be used to shelter the user from the sun and insects, such as during the summer. When the assembly 2 is constructed for summer use, the materials are adjusted to provide light colors, lighter weight fabrics and/or transparent materials. Screen panels can also be provided at the shelter walls 8-14 for insect protection.

In all conditions, the weight of the seated occupant primarily anchors the assembly 2. Accessory equipment might also be set on a fringe piece or apron 22 located along the sides at the floor of the shelter 4 or at a shelter framework 24 to anchor the assembly 2 from being swept along over the ice or ground. Extraneous weights or weight support pockets can also be sewn into the walls 8-14 to anchor the shelter 4. Ground or ice anchors and appropriate lashings might also be used. Although the construction of the assembly 2 at FIGS. 1-8 is principally described in relation to an ice fishing application, FIGS. 9-15 depict alternative assemblies that can be used for hunting and under warm weather conditions for camping, picnicking or at the beach, as a windbreak, sun shade, insect cover or rain cover.

With attention to FIGS. 1 and 4, the chair 6 of the assembly 2 is configured from a framework 30 of formed tubular or solid frame pieces 32. The frame pieces are trained through grommets 34 in a sling seat 36 and a backrest piece 38. The seat 36 and backrest 38 can be constructed as one or more pieces. Some of the ends of the frame pieces 32 mount in fabric pockets or sleeves 40. Others of the ends mount or are fastened to molded and/or jointed couplers 42. Sling armrests 44 extend along the sides of the chair 6 and can include pockets 46 for containing canned beverages or cups. Other pockets 47 can depend from the edges of the seat 36, armrests 44 or the back of the backrest piece 38. Other pockets 48 can be secured to the interior of the shelter wall(s) 8-14 to be used for storing sundry paraphernalia. Still other pockets 50 provided at the exterior of the shelter wall(s) 8-14 can contain items such as name/identification/license information. Flexible or rigid bows and/or stays 52 can also be fastened to or secured in pockets or sleeves formed into the shelter walls 8-14 to maintain rigidity against gusting winds.

Although one style of chair 6 is shown, other types and styles of user supports or chairs 6 can be adapted to the assembly 2. For example, chairs 6 with rigid seats and backs can be used (e.g. solid plastic lawn chairs or folding chairs). Folding chairs with woven webbing or cushioned seats and backrests might be used. The manner of attachment of the chair pieces and deployment/collapsing of the chair pieces can also be varied. The chair 6 might also be constructed to recline or merely provide a seat surface in the manner of a stool. The interconnecting members between the shelter 4 and chair 6 can be varied to accommodate the particular construction of the user support.

With additional attention to FIGS. 5-8, the construction of the shelter framework 24 and the typical manner of deployment of the assembly 2 follows. The shelter framework 24 is constructed of four multi-section, supports 60 of an appropriate shape (e.g. ∩-shaped) that displace the shelter 4 away from the lateral sides of the chair 6 and above a seated occupant. The number and type of supports 60 can be varied depending upon the design and application constraints of the assembly 2. The shape of the supports 60 may also be varied to any of a variety of generally inverted U-shapes, wherein side and top wall support portions can exhibit straight, arcuate or compound shapes.

The supports 60 can be constructed as continuous lengths of fiberglass or metal members. The supports 60 of FIGS. 1-8, however, are constructed in multi-sectional form. The supports 60 can provide telescoping sections or sections that mate at interconnecting couplers. The supports 60 can also include an elastic cord threaded through hollow bores of each section to facilitate alignment during assembly erection.

The ends of the supports 60 are presently secured to pivot wings 62 at the ground level. Right and left side support sections 64 and 65 project from the wings 62 to pivot couplers 66, where top section pieces 68 are pivotally secured and traverse the top of the chair 6. Intermediate couplers 67 are provided at the top section pieces 68 to allow the top section to bend or fold for storage. The exposed surfaces of the wings 62 and couplers 66 and 67 are formed to minimize possible stress or tearing at the adjoining fabric. The wings 62 and/or couplers 66 might also be configured as latching assemblies to maintain a pre-stressed flex in the support sections 64, 65 and 68 when deployed. Such a stressed condition normally exists with a continuous, flexible single section support 60. The pivot pins at each wing 62 and coupler 66 and/or 67 are arranged relative to the coupler body to provide an optimal pivot action without over-rotation of the various sections 64, 65, 66 of the supports 60.

Figure 5:
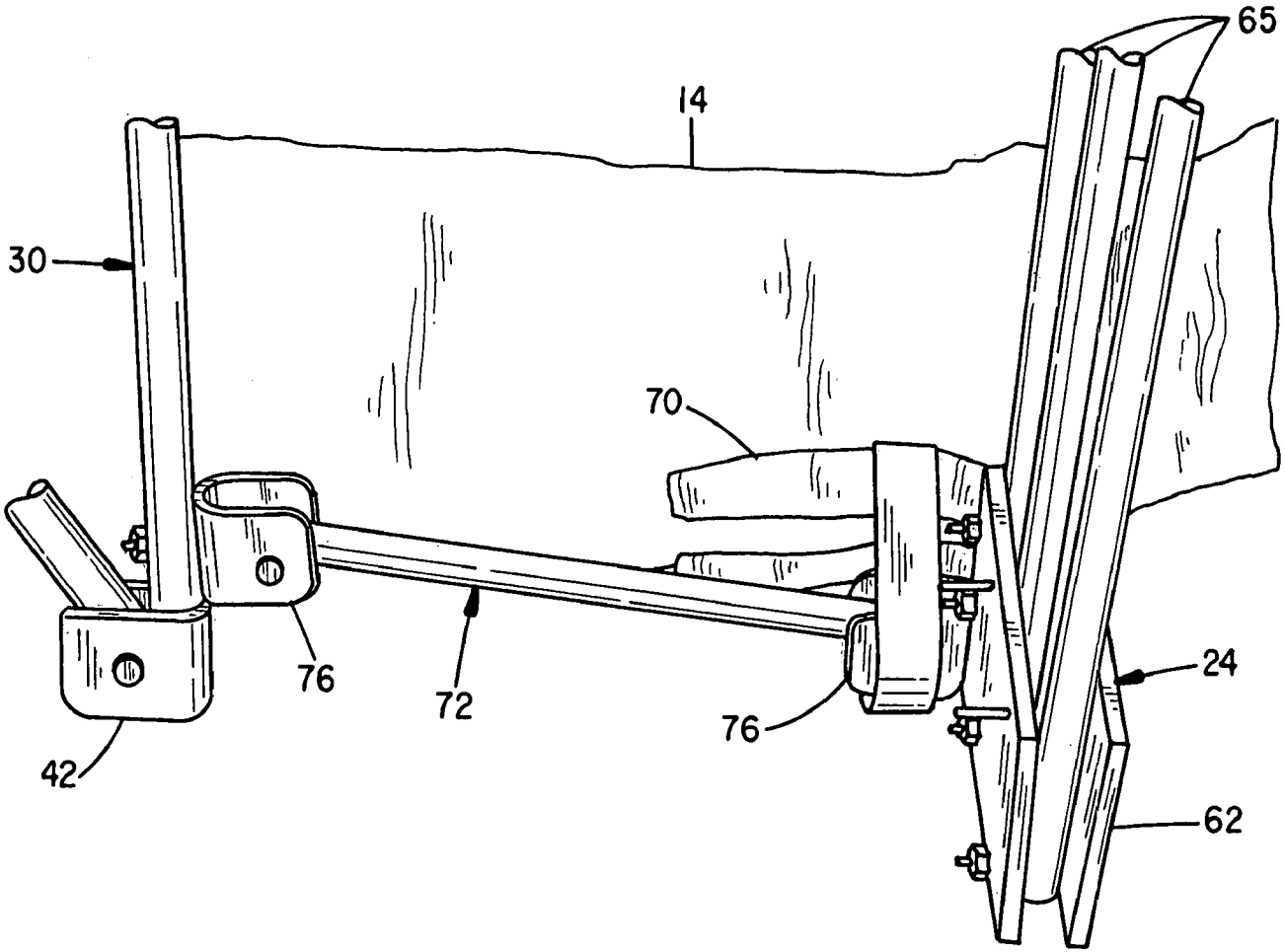
FIG. 5 shows a perspective drawing to the lower chair-to-shelter link arm and pivot couplers.

The supports 60 are arrayed to sufficiently displace the shelter 4 away from the sides and top of the chair 6 to prevent contact with the seated occupant, especially during windy conditions. The supports 60 can be secured in pockets sewn into the shelter walls 8-14 or can be secured with loops or lengths of hook/loop fastener material sewn to the shelter walls 8-14. The supports 60 thereby also act as stays to maintain a taught surface at the shelter 4 when expanded. The rear shelter wall 14 is secured to the pivot wings 62 or control arms described below with lengths of hook/loop fastener material 70 as shown at FIG. 5. Stop pins 71 fitted to appropriate holes in the pivot member(s) 62 can limit or restrict the rotation of the members 60. Appropriate straps might also be used to restrain rotation of the supports 60.

Figure 6:
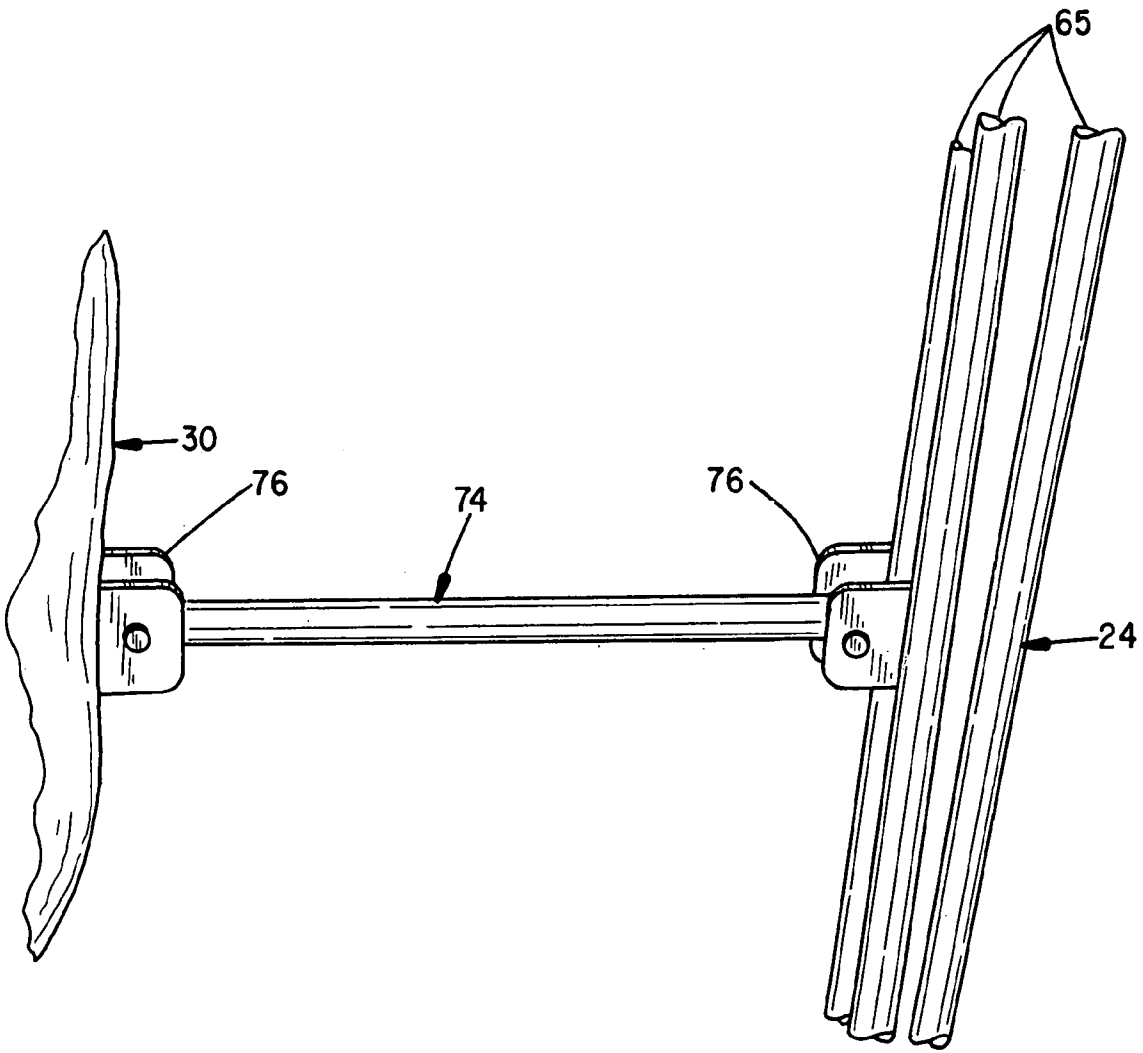
FIG. 6 shows a perspective drawing to the upper chair-to-shelter link arm.

Laterally extending from the pivot wings 62 to the chair framework 30 are lower control arms 72 as shown at FIGS. 1, 4 and 5. Upper control arms 74 extend from the rearmost support 60 to the upper extremities of the chair framework 30 as shown at FIG. 6. The length of the control arms 72 and 74 are sized to assure adequate clearance from the seated occupant. Pivot couplers 76 fix the ends of the control arms 72 and 74 to the frameworks 24 and 30. The control arms 72 and 74 can be constructed to telescope and/or selectively decouple with clips or latch fasteners from either the chair 6 or shelter 4.

Figure 7:
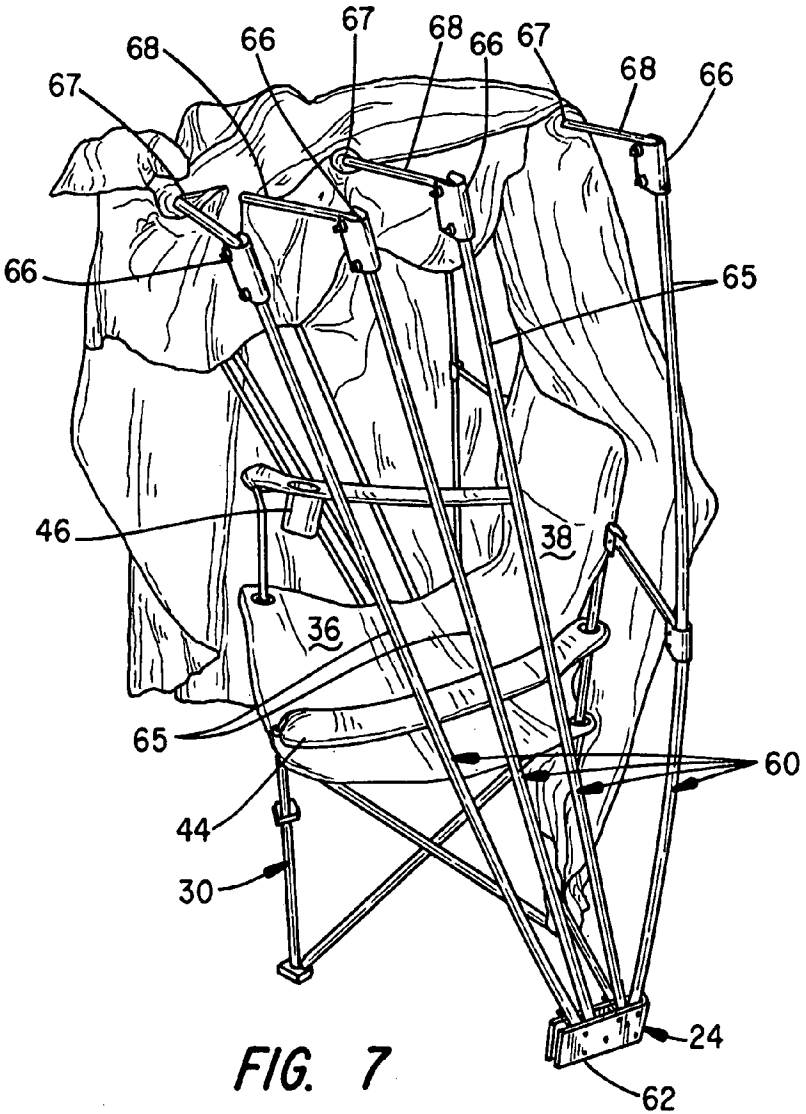
FIG. 7 shows a perspective view of the shelter in a partially collapsed condition relative to the deployed chair.
Figure 8:
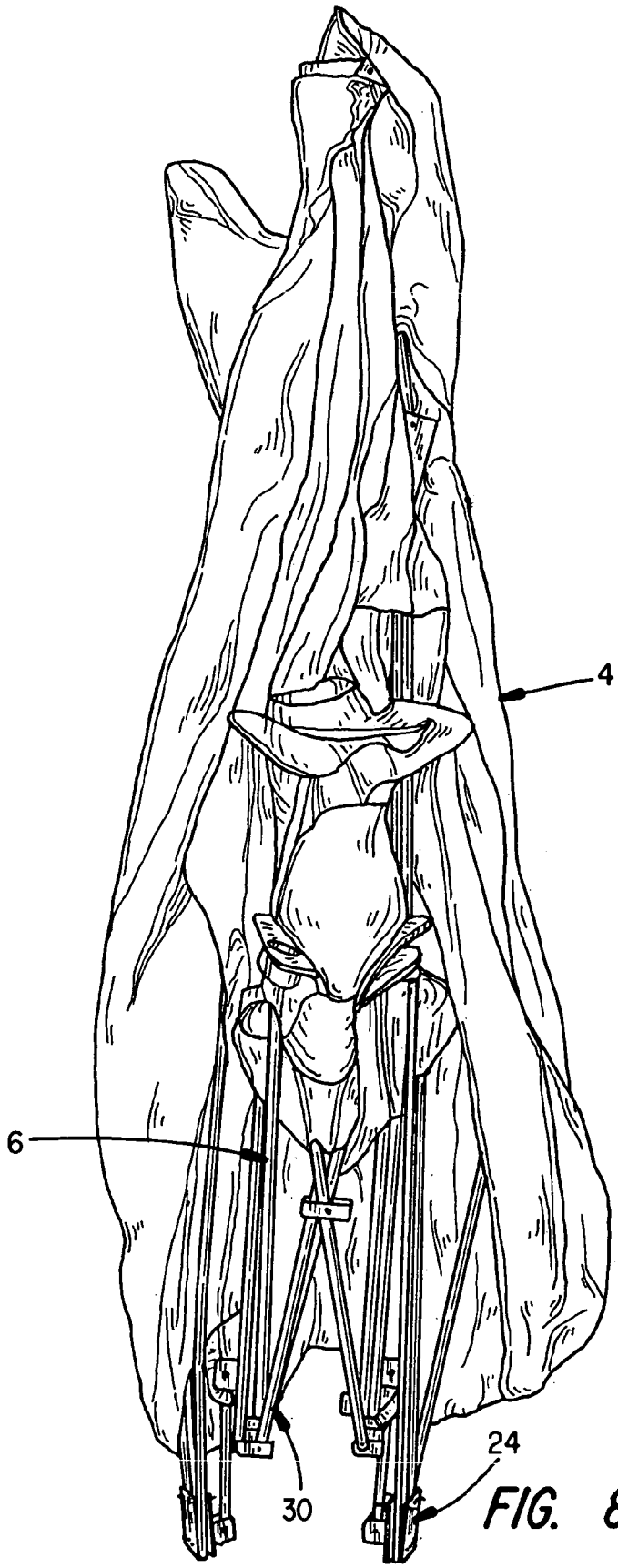
FIG. 8 shows a perspective view of the shelter and chair in collapsed conditions, prefatory to transport or storage of the chair/shelter in a surrounding carry case.
Figure 9:
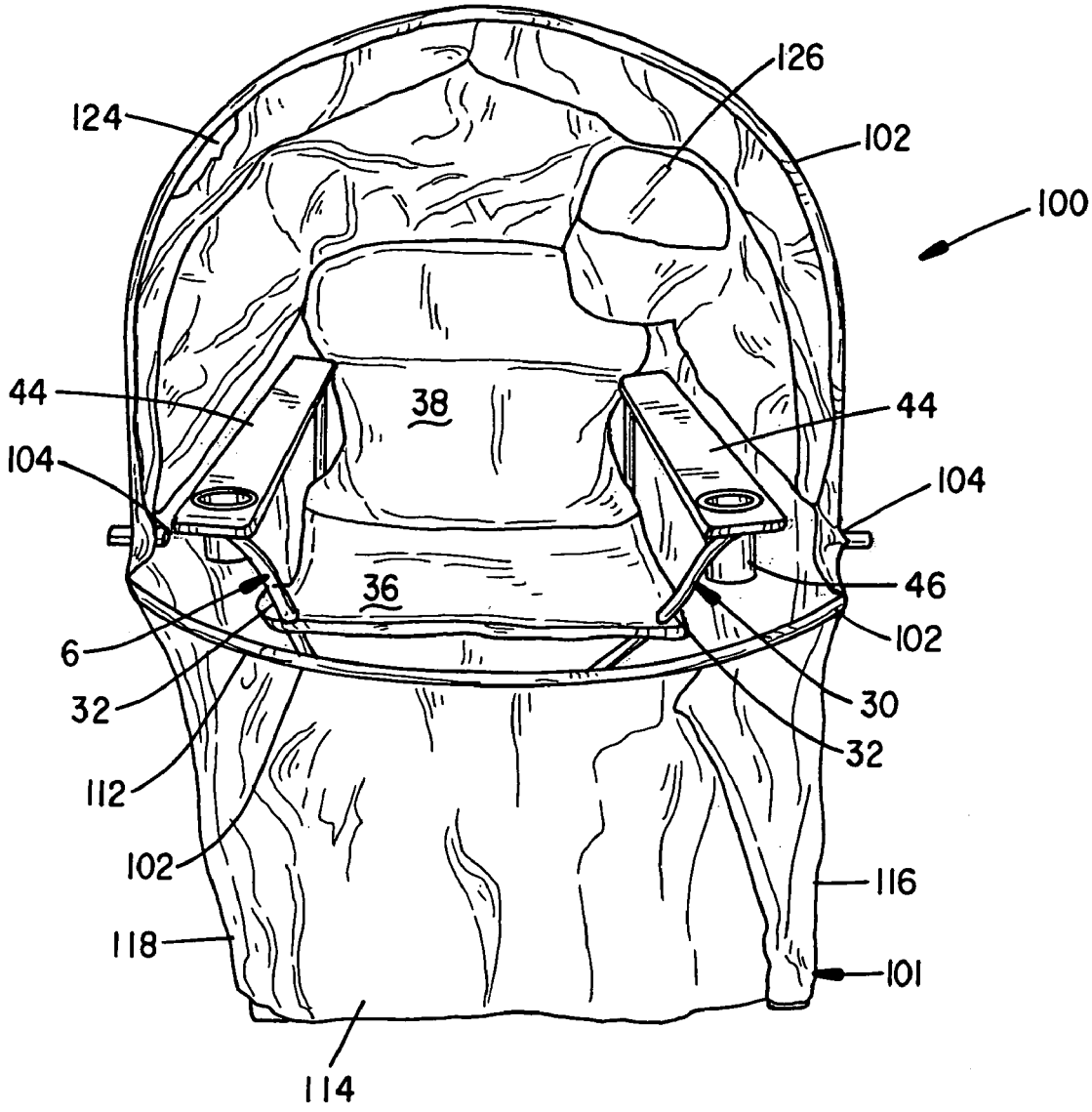
FIG. 9 shows a front perspective view of a second construction of the present shelter with the shelter lowered to expose the user chair through an access space.
Figure 10:
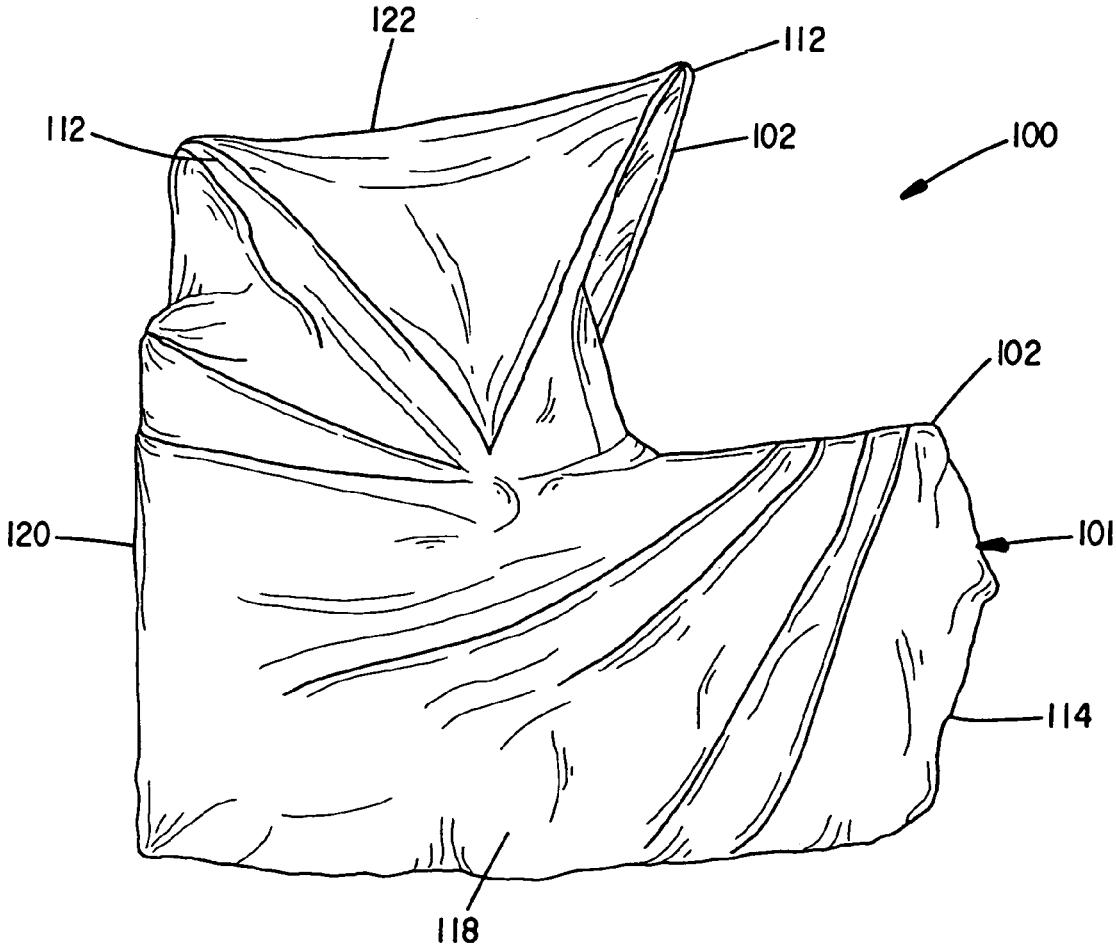
FIG. 10 shows a side view of the shelter rotated to completely enclose the chair and user.
Figure 11:
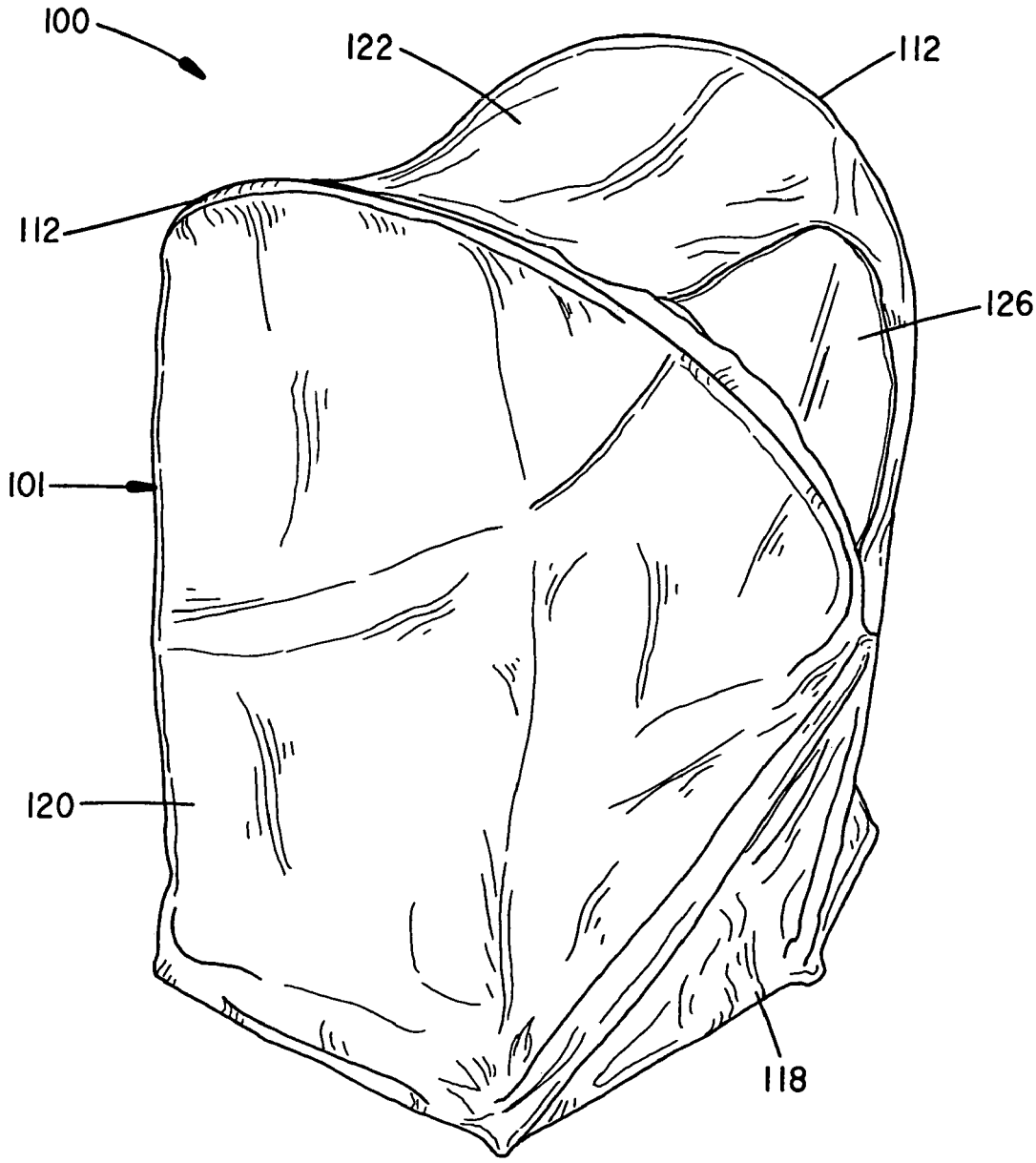
FIG. 11 shows a rear perspective view of the shelter rotated to a lowered condition.
Figure 12:
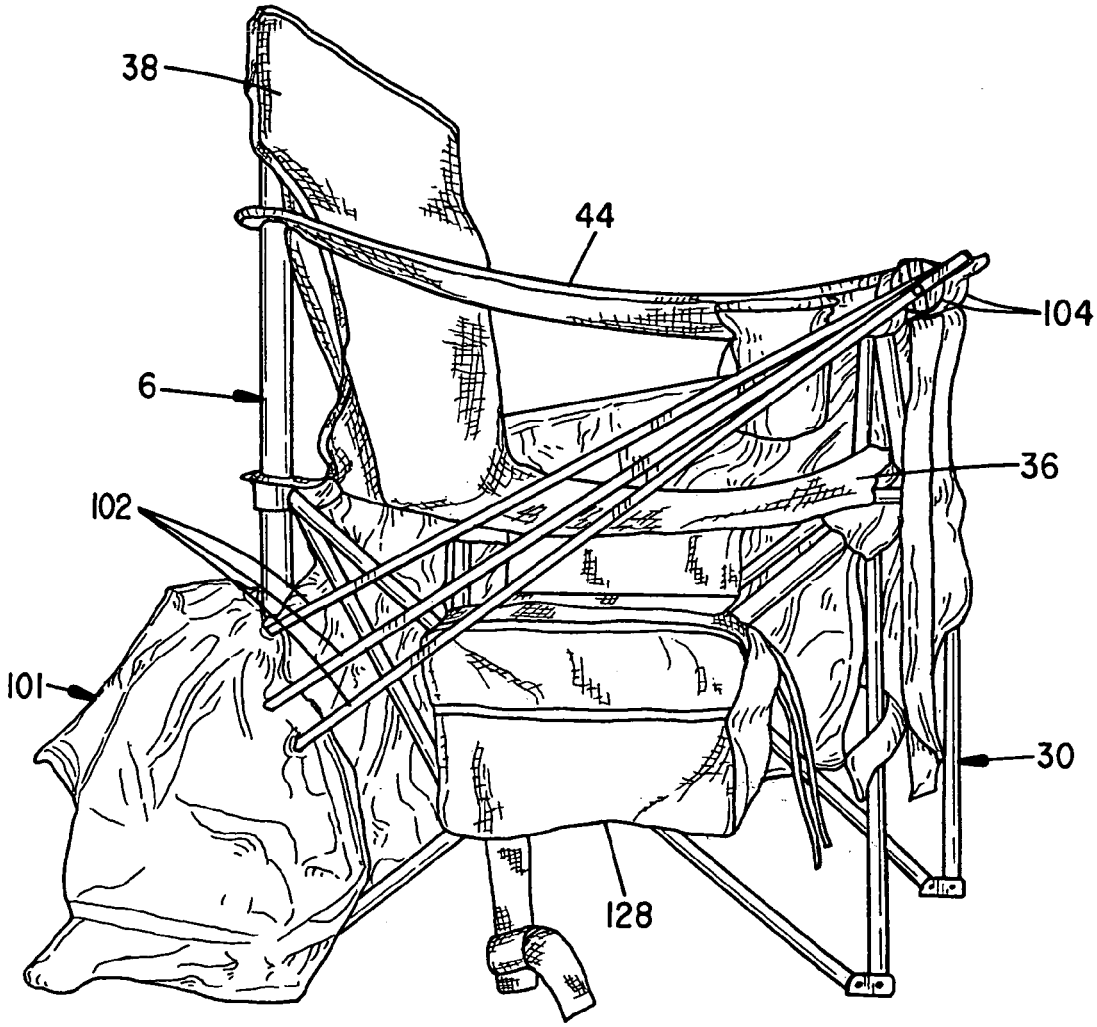
FIG. 12 shows a perspective view of the shelter in a partially collapsed condition relative to the deployed chair.

FIG. 7 depicts the shelter framework 24 in a partially collapsed condition wherein the shelter fabric is collected about the expanded chair 6. FIG. 8 in contrast depicts the chair framework 30 collapsed and the shelter framework 24 collapsed about the chair framework 30 with the fabric walls 10, 12 and 14 and seat 36, backrest 38 and arms 44 collapsed. The controls arms 72 and 74 and the top sections 68 are folded against the collapsed frameworks 24 and 30 to facilitate storage in a stuff bag on the order of 48 to 60-inches.

Although one preferred shape is shown, the shelter 4 can be adapted to a variety of geometric shapes. When rotated to the shelter condition (FIG. 2), the shelter 4 defines a hemi-spherical-like shape and when rotated to the "windbreak" condition (FIGS. 1 and 4), the shelter 4 forms a barrier or obstruction to the wind. Thus, the depicted shapes should not be deemed limiting.

FIGS. 9 to 12 depict a second construction of the invention or a chair-shelter assembly 100. The assembly 100 is configured for use in hunting, such as waterfowl hunting. A chair 6 is centered in the assembly 100 and a fabric shelter 101 is supported to the chair 6 with a number of continuous, flexible, bowed stays 102 are arranged to pivot about the chair 6. The lengths of the stays 102 are sized to span the chair 6 over their ranges of rotation so as not to contact a seated occupant. The resilience of the stays 102 is selected to prevent undue flexion with wind to minimize against collapse or movement of the shelter walls to contact a seated occupant. The stays 102 can be constructed of spring steel, plastic, fiberglass or other suitable material.

Figure 13:
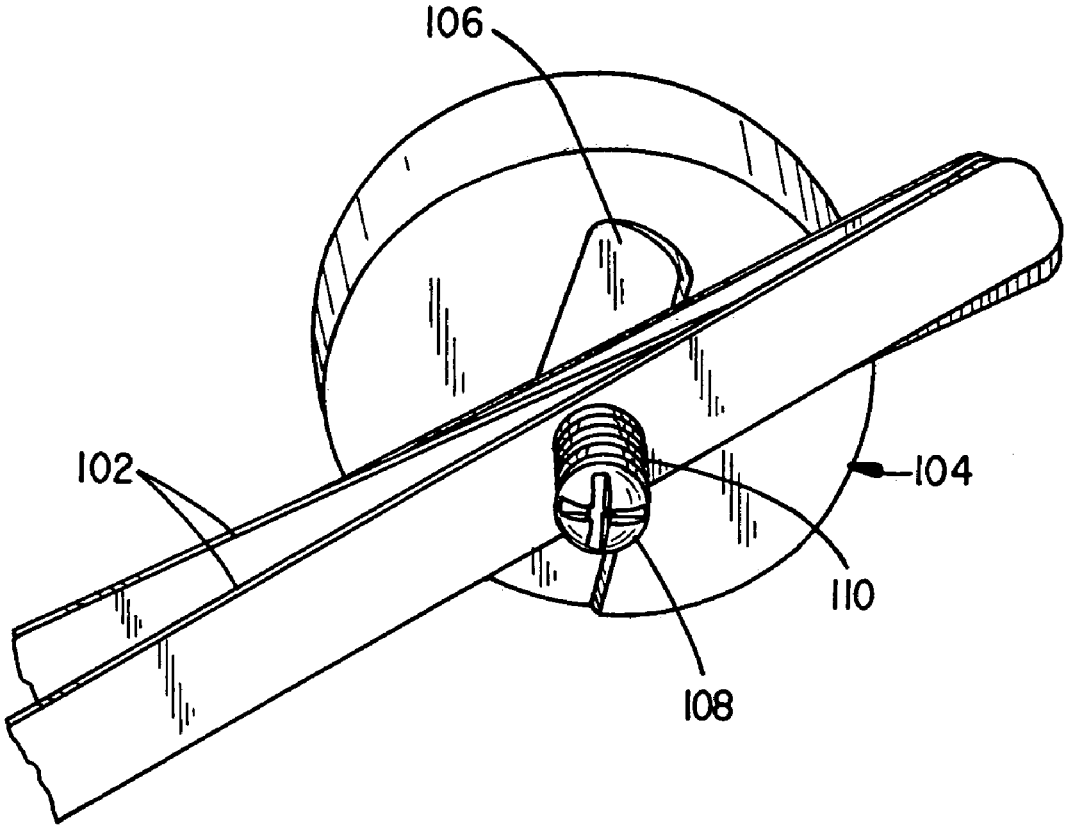
FIG. 13 shows a detailed view to one of the bow stay pivots.
Figure 14:
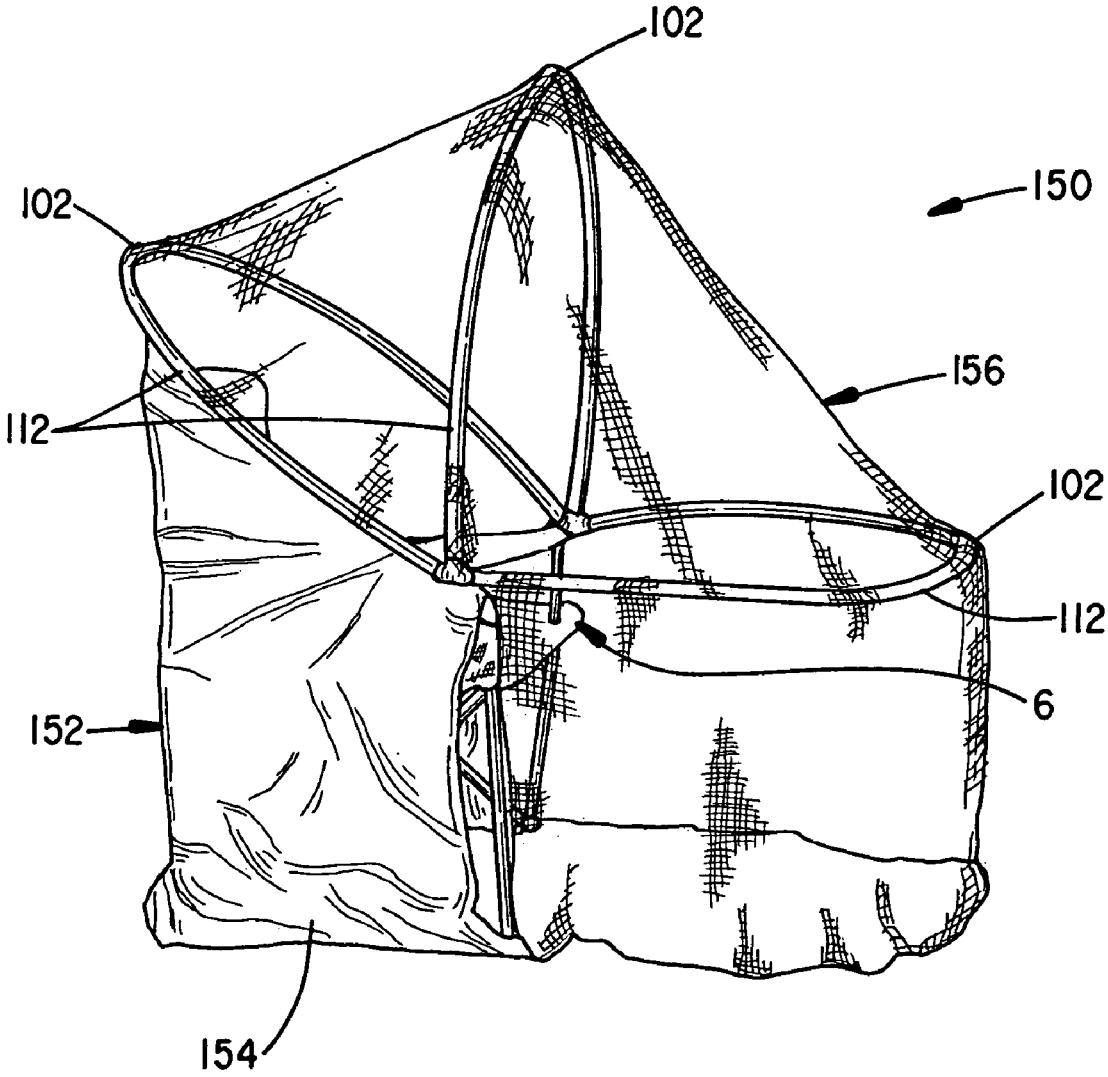
FIG. 14 shows a front perspective drawing to a third construction to a summer/insect-proof shelter.

The ends of the stays 102 are secured to pivot at hinge couplers 104 at the chair frame 30, which couplers 104 are shown in detail at FIG. 13. The pivot or hinge couplers 104 are particularly mounted to ends of frame pieces 32 at the fronts of the armrests 44. A slot 106 is formed into the coupler 104 to receive the forward or innermost stay 102 that projects in front of the occupant. The remainder of the stays 102 overly one another and are secured with a pivot fastener 108 and spring 110. The forward or inner stay 102 thus causes the coupler 104 to rotate about the fastener 108 and the other stays 102 merely rotate about the fastener 108. A stop is provided at the back of the coupler 104 that interacts with the chair frame 30 to prevent over rotation.

The stays 102 are mounted in sleeves 112 sewn into a front skirt 114 and right and left sidewalls 116 and 118, a rear wall 120 and a top wall 122. The range of stay rotation is depicted over the series of FIGS. 9-12. The flexibility of the stays 102 is selected such that when the chair 6 is collapsed in conventional fashion, the stays 102 flex sufficiently to permit the assembly 100 to stow in a storage bag (not shown).

A removable panel 124 can be secured between the skirt 114 and the top wall 122 with appropriate zipper or hook and loop fasteners to allow for unobstructed viewing to the front of the chair. Transparent windows 126, otherwise, can be provided at any desired location to allow the occupant to view different sectors of the sky. Zippers or other fasteners can also be provided in the walls to permit the occupant to create an opening or window 126 of appropriate size, as desired or needed. An equipment storage container 128 with several compartments and associated strapping 130 is provided along one side of the chair 6.

Figure 15:
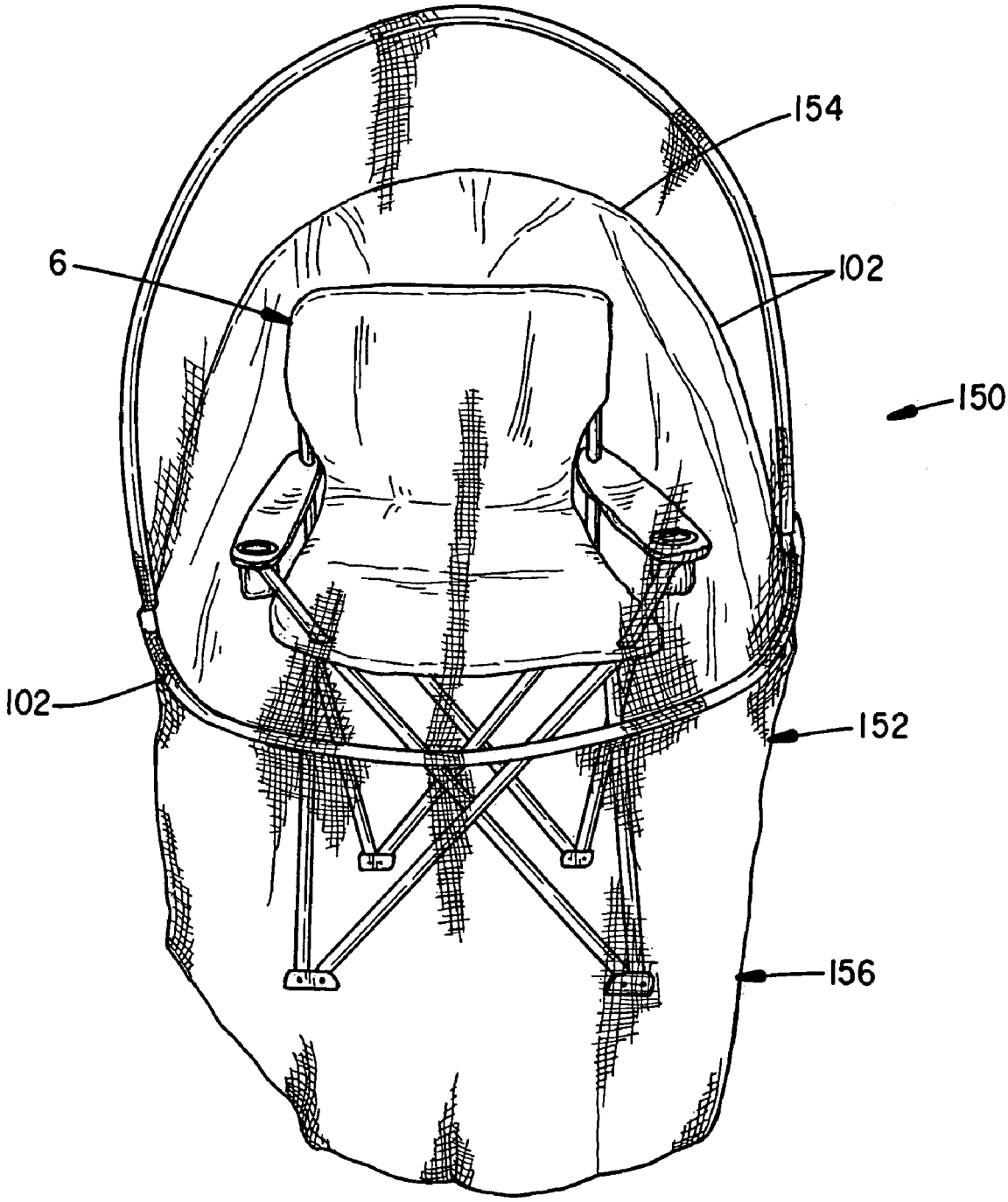
FIG. 15 shows a side perspective drawing of the summer/insect-proof shelter.

FIGS. 15 and 16 depict yet another chair-shelter assembly 150. The assembly 150 is constructed for warm weather applications, such as trips to the beach or picnics. A chair 6 is centered in the assembly 150 and surrounded by a lightweight fabric and mesh walled shelter 152. A rear and partial sidewall panel 154 is formed from a solid, windbreak material and the remainder of the walls are constructed with a mesh material 156. The mesh is selected to resist penetration by insects and bugs yet provide screening from the sun and movement of breezes through the mesh material. The assembly 150

While the invention has been described with respect to considered alternative assemblies and considered improvements or alternatives thereto, still other assemblies may be suggested to those skilled in the art. It is also to be appreciated that selected ones of the foregoing components can be used singularly or can be arranged in different combinations to provide a variety of improved shelter assemblies. The foregoing description should therefore be construed to include all those embodiments within the spirit and scope of the following claims.

What is claimed is:

1. A shelter comprising:

a) a chair including a framework comprised of a plurality of interlocking frame pieces and a plurality of fabric members mounted to said frame pieces to define a seat, a backrest and first and second armrests including first and second pivot axles that project from distal ends of said first and second armrest defining frame pieces;

b) first and second pivot pieces respectively mounted to radiate from said first and second pivot axles;

c) a plurality of flexible struts mounted to said first and second pivot axles, span said framework, pivot about said first and second pivot axles, and engage said first and second pivot pieces; and d) a fabric cover fastened to said struts to rotate between a transport condition wherein said shelter collapses to a generally elongated, cylindrical configuration and a deployed condition wherein said struts and cover rotate to enclose and completely cover said chair.

2. A shelter as set forth in claim 1 wherein said cover comprises a plurality of sewn panels.

3. A shelter as set forth in claim 2 wherein one of said fabric panels comprises a transparent material.

4. A shelter as set forth in claim 2 wherein one of said fabric panels comprises a screen material.

5. A shelter as set forth in claim 1 wherein said frame pieces are secured to said fabric members to collapse to a unitary assembly and deploy to define a sling seat, sling backrest and first and second sling armrests.

6. A shelter as set forth in claim 1 wherein said pivot pieces exhibit a diameter substantially greater than the width of said struts to displace said struts and cover away from said framework and an occupant seated at said chair.

7. A shelter as set forth in claim 1 including means for retaining said plurality of struts in an upright condition to expose said chair.

8. A shelter as set forth in claim 1 wherein said fabric cover includes a plurality of storage pockets.

9. A shelter as set forth in claim 1 wherein said fabric cover includes a plurality of vent apertures.

10. A shelter as set forth in claim 1 wherein said fabric cover includes a transparent window.

11. A shelter as set forth in claim 1 wherein said first and second pivot pieces each comprise an annular member having a bore through which one of said first and second pivot axles extends.

12. A shelter as set forth in claim 11 wherein at least one of said first and second pivot pieces includes a slot for containing a portion of at least one of said struts.

13. A shelter as set forth in claim 1 wherein said first and second pivot pieces each comprise an annular member having a bore through which one of said first and second pivot axles extends and further having a slot for containing a portion of at least one of said struts.

14. A shelter comprising:

a) a chair including a framework comprised of a plurality of interlocking frame pieces and a plurality of fabric members mounted to said frame pieces to define a seat, a backrest and first and second armrests;

b) first and second pivot axles comprising distal ends of first and second armrest defining frame pieces and including first and second circular pivot pieces mounted to radiate from said first and second pivot axles;

c) a plurality of flexible struts mounted to said first and second pivot axles, span said framework, pivot about said first and second pivot axles and engage said first and second pivot pieces to displace said struts away from said framework; and d) a fabric cover fastened to said struts to rotate between a transport condition wherein said shelter collapses to a generally elongated, cylindrical configuration and a deployed condition wherein said struts and cover rotate to enclose and completely cover said chair.

15. A shelter as set forth in claim 14 wherein said first and second pivot pieces each include a slot for containing a portion of at least one of said struts.

16. A shelter comprising:

a) a chair including a framework comprised of a plurality of interlocking frame pieces and a plurality of fabric members mounted to said frame pieces to define a seat, a backrest and first and second armrests and wherein said framework supports first and second pivot axles;

b) first and second annular pivot pieces, each having a bore through which one of said first and second pivot axles extends;

c) a plurality of flexible struts mounted to said first and second pivot axles, span said framework, pivot about said first and second pivot axles and engage said first and second pivot pieces to displace said struts away from said framework; and d) a fabric cover fastened to said struts to rotate between a transport condition wherein said shelter collapses to a generally elongated, cylindrical configuration and a deployed condition wherein said struts and cover rotate to enclose and completely cover said chair.

17. A shelter comprising:

a) a chair including a framework comprised of a plurality of interlocking frame pieces mounted to define and support a seat portion and wherein said framework supports first and second pivot axles and first and second washer-shaped pivot pieces mounted to radiate from said first and second pivot axles;

b) a plurality of flexible struts mounted to said first and second pivot axles, span said framework, pivot about said first and second pivot axles and engage said first and second pivot pieces to displace said struts away from said framework; and c) a fabric cover fastened to said struts to rotate between a transport condition wherein said shelter collapses to a generally elongated, cylindrical configuration and a deployed condition wherein said struts and cover rotate to enclose and completely cover said framework.

18. A shelter as set forth in claim 17 including first and second sling-mounted arm rests.

19. A shelter as set forth in claim 17 wherein said first and second pivot pieces each include a slot for containing a portion of at least one of said struts.

* * * * *